US006887282B2

(12) United States Patent
Giampa et al.

(10) Patent No.: US 6,887,282 B2
(45) Date of Patent: May 3, 2005

(54) TALL OIL PITCH AND FATTY ACID-BASED CHEMICAL CHANGE AGENT [CCA] FORMULATION FOR SOLID AND SYNTHETIC FUEL PRODUCTION

(75) Inventors: Vince M. Giampa, Apollo Beach, FL (US); John T. Dubiel, Proctorville, OH (US); Orville Lyons, Louisa, KY (US)

(73) Assignee: Ceredo Liquid Terminal Inc., St. Petersburg, FL (US)

( * ) Notice: Subject to any disclaimer, the term of this patent is extended or adjusted under 35 U.S.C. 154(b) by 217 days.

(21) Appl. No.: 10/068,285

(22) Filed: Feb. 5, 2002

(65) Prior Publication Data

US 2003/0145516 A1 Aug. 7, 2003

(51) Int. Cl.[7] ..... C10L 5/00; C10L 9/10

(52) U.S. Cl. ..... 44/301; 44/306; 44/307; 44/308; 44/564

(58) Field of Search ..... 44/301, 306, 307, 44/308, 564

(56) References Cited

U.S. PATENT DOCUMENTS

| | | | | | |
|---|---|---|---|---|---|
| 4,265,638 | A | | 5/1981 | Burke | |
| 4,357,145 | A | | 11/1982 | Dondelewski | |
| 4,406,664 | A | | 9/1983 | Burgess et al. | |
| 4,437,896 | A | | 3/1984 | Partanen | |
| 4,454,113 | A | * | 6/1984 | Hemker | 424/63 |
| 4,548,615 | A | * | 10/1985 | Lonchamp et al. | 44/561 |
| 4,634,450 | A | * | 1/1987 | Ljusberg-Wahren | 44/280 |
| 4,634,452 | A | * | 1/1987 | Secor | 44/306 |
| 4,678,562 | A | | 7/1987 | Keys | |
| 4,696,638 | A | * | 9/1987 | DenHerder | 431/4 |
| 4,715,866 | A | | 12/1987 | Staker et al. | |
| 4,822,425 | A | | 4/1989 | Burch | |
| 4,957,511 | A | * | 9/1990 | Ljusberg-Wahren | 44/280 |
| 5,004,479 | A | | 4/1991 | Schon et al. | |
| 5,082,469 | A | | 1/1992 | Kain et al. | |
| 5,100,438 | A | | 3/1992 | Kain et al. | |
| 5,178,640 | A | | 1/1993 | Girardi et al. | |
| 5,178,674 | A | * | 1/1993 | Schilling et al. | 106/277 |
| 5,188,658 | A | | 2/1993 | Aune et al. | |
| 5,716,917 | A | * | 2/1998 | Williams et al. | 508/547 |
| 5,752,993 | A | | 5/1998 | Eatough et al. | |
| 5,928,418 | A | | 7/1999 | Tamaki et al. | |
| 6,020,377 | A | | 2/2000 | O'Quinn et al. | |
| 6,077,340 | A | | 6/2000 | Doyle | |
| 6,589,442 | B1 | * | 7/2003 | Wilson et al. | 252/70 |
| 6,682,593 | B2 | * | 1/2004 | Burch | 106/222 |
| 2002/0020109 | A1 | | 2/2002 | Donovan et al. | |

* cited by examiner

*Primary Examiner*—Cephia D. Toomer
(74) *Attorney, Agent, or Firm*—Bracewell & Patterson LLP

(57) ABSTRACT

A chemical change agent containing water, tall oil, glycerides, and surfactants is used to create synthetic fuels. An alternate composition contains water, glycerides, and surfactants. The chemical change agent is formed by heating the tall oil; combining water, fatty acids, and surfactant; and adding the heated tall oil and the water, fatty acid, and surfactant to form an emulsion. The synthetic fuel contains coal and the chemical change agent. The synthetic fuel is formed by mixing coal with the chemical change agent and pressing the two components into a briquette or other suitable treatment to create a finished product.

23 Claims, No Drawings

TALL OIL PITCH AND FATTY ACID-BASED CHEMICAL CHANGE AGENT [CCA] FORMULATION FOR SOLID AND SYNTHETIC FUEL PRODUCTION

BACKGROUND OF THE INVENTION

1. Field of the Invention

The present invention relates to a formulation of a solid synthetic fuel, or synfuel, and in particular to the chemical change agent (CCA) useful for such synfuel. More particularly, this invention relates to CCA's using tall oil pitch emulsions and fatty acid emulsions.

2. Description of the Prior Art

Solid synfuels can be produced from coal through a chemical interaction between feedstock coal and a CCA. Synthetic fuels have been recognized as a desirable alternative fuel source. Section 29 of the Internal Revenue Code recognizes qualified fuels, including solid synthetic fuel produced from coal, by giving tax credits for producing fuel from a non-conventional source. These synthetic fuels must exhibit "significant chemical change" when compared to the feedstocks.

Emulsions using tall oil pitch have been used as a binder, for production of synthetic fuel and also for the asphalt industry. An example of using tall oil pitch as a carboneous binder can be found in U.S. Pat. No. 5,188,658 issued to Aune et al. In Aune, tall oil pitch was used as a carboneous binder in an agglomerating said zinc containing material. However, previous emulsions were ineffective to create the degree of chemical change required. Other difficulties with known tall oil pitch emulsions excessively high viscosity, and material handling difficulties. An example of such a tall oil pitch emulsion can be found in U.S. Pat. No. 4,437,896 issued to Partanen. The Partanen emulsion was prepared from blends of tall oil and/or tall oil pitch and naturally occurring or man made gilsonite.

U.S. Pat. No. 6,077,340 to Doyle (hereinafter "Doyle patent") teaches a chemically-stabilized emulsion of tall oil in an aqueous emulsifier solution. The aqueous emulsifier solution comprises water, acids, and emulsifiers. The pH of the emulsion is controlled between 3 and 7 to prevent saponification and neutralization of the naturally occurring acids in the tall oil. To help stabilize the emulsion, the tall oil and water comprise a majority by weight of the emulsion. This emulsion is used for soil treatment, for reclamation of asphalt and remediation of heavy metal contaminated soil. While a tall oil-in-water emulsion is disclosed, this emulsion is used as a binder typically for soil stabilization and not as a CCA.

In addition to teaching that the emulsion is for use in the reclamation of asphalt, not in the creation of synfuel, the Doyle patent teaches the use of an emulsion that has a pH below the 6.5 to 7.0 range. This pH range would allow microbial growth in an emulsion containing fatty acids, particularly in the 5.0 to 7.0 pH range. Raising the pH of the CCA to the 7 to 10 range controls the formation of anaerobic bacteria. Increasing storage temperature and provisions for storage tank agitation have also proven effective to reduce microbial growth.

While Doyle discloses an emulsion of tall oil in water, this emulsion is applied only to the disparate soil remediation industry, and not the synfuel industry. The Doyle emulsion, which contains primarily tall oil, would not be an effective CCA for synfuel. Finally, saponification is undesirable in Doyle but is useful in one embodiment of the current invention as the addition of caustic not only adjusts pH, but also creates soap in the oil.

Examples of known binders for use as a chemical change agent include the CCA taught in U.S. Pat. No. 5,178,640 to Girardi. The Girardi patent discloses a method for preparing a synthetic fuel, or synthetic components for fuels, using a polycarboxylic acid mixture for the oxidation of coal. While this patent teaches a CCA that avoids the use of asphalt with its deleterious environmental consequences, the Girardi patent requires an oxidation process, which is much more expensive than the process required in the present invention, which only requires mixing and pressing.

Other types of pitches have been utilized in prior art. One such example is found in U.S. Pat. No. 4,822,425 issued to Burch (hereinafter "Burch patent") that discloses an aggregate-stabilizing emulsion of pine tar pitch, rosin, an emulsifying agent and water for use in road construction. Again, the use of this emulsion is very different from the CCA of the current invention to create synfuel. While rosins are the residue of distillation products of resins and the oleoresins contain essential oils, the composition of rosin varies greatly from the triglycerides of the current invention.

It is, therefore, an object of this invention to provide synthetic fuel producers with a CCA that is more readily available, most reactive when combined with coal, more economical, and more environmentally friendly. The incorporation of fatty acids within the CCA have resulted in an improved CCA for synfuel applications.

It is a related object of this invention to provide an asphalt emulsion that produces a product that flows when crushed and that has incendiary properties similar to coal, preventing premature combustion. It is another object to produce a synfuel that minimizes safety risks when stored or processed and produce an emulsion with improved characteristics for handling and application. Further objects of this invention are to minimize the total cost of producing a qualified synthetic fuel with given performance characteristics and increase the diversity of available supply for solid phase of CCA formulation. Other objectives include providing a CCA capable of producing enhanced chemical change when compared to current tall oil pitch emulsions and producing a CCA with lower viscosity for a given chemical change capacity. It is yet a further object to create an environmentally-friendly CCA.

BRIEF SUMMARY OF THE INVENTION

In order to meet one or more of the identified objects, the present invention includes a composition of an emulsion chemical change agent [CCA] and a resulting synfuel. The CCA includes water from 0 to 70 wt. %, a tall oil pitch from 0 to 60 wt. %, glycerides from 0.25 to 40 wt. %, and surfactants from 0.25 to 4 wt. % of the emulsion CCA. As a second formulation, the CCA can be prepared with water from 0 to 70 wt. %, glycerides from 10 to 40 wt. %, and surfactants from 0.25 to 4 wt. % of the emulsion CCA.

This composition is emulsified using traditional methods such as colloid mill or turbine type rotor-stator device. In a preferred embodiment, the oil useful in the CCA is characterized as having an average boiling point of at least 700° F. (371° C.). The tall oil may be a natural unrefined product, a distilled product or a refined product. Tall oil pitch is an example of a refined product. A preferred embodiment of the surfactant useful in the CCA includes an anionic soap, such as that produced by reacting crude tall oil with a suitable base. An example of such a suitable base is caustic, or sodium hydroxide. Other examples will be known to one skilled in the art.

Another preferred embodiment of the oil in the CCA includes the oil being characterized as having a flash point of at least 392° F.(200° C.).

A preferred embodiment includes synthetic fuel where the CCA is between 0.5–1.2% weight of the coal.

The method and product of the present invention as well as other features, advantages, benefits and objects thereof over other methods and products known in the art may be better understood with reference to the detailed description which follows.

DETAILED DESCRIPTION OF THE INVENTION

The present invention includes a composition of an emulsion CCA and a resulting synfuel. The preferred embodiment for the CCA includes water from 0% to 70% by weight of the emulsion CCA, tall oil pitch from 0% to 60% by weight of the emulsion CCA, glycerides from 0.25% to 40% by weight of the emulsion CCA, and surfactant from 0.25% to 4% by weight of the emulsion CCA. The fatty acid, or glyceride, concentrate is preferably low in moisture and high in fatty acid content. Preferred fatty acids are vegetable oils, including products derived from vegetable oil distillates, and are in the C16–C18 carbon range typically. Fatty acids can also be in the solid phase, as well. For the CCA emulsions of this invention, the term solid phase refers to a non-continuous emulsion phase, also called the oil phase. The surfactant is preferably either anionic or non-ionic. The finished CCA is formulated to a pH that is preferably in the neutral to slightly basic range of 7 to 11.

The CCA can also be produced without tall oil pitch, since fatty acids alone contribute to chemical change. With this formulation, the CCA includes water from 0% to 70% by weight of the emulsion CCA, glycerides from 10% to 40% by weight of the emulsion CCA, and surfactant from 0.25% to 4% by weight of the emulsion CCA.

In the preferred embodiment of the composition, preparation of the emulsion involves introduction of two streams into a colloid mill capable of imparting shear to the mixture to create droplets in the 5–10 micron size range. The first stream contains tall oil pitch heated to a temperature of at least 200° F. (93° C.). Heating the pitch is necessary in order to allow the pitch to assume fluid properties for handling and emulsion formation. The second stream contains fatty acids, also called glycerides, and surfactants.

The emulsion is prepared using a process that separates the oil into small droplets and then keeps them from joining back together. A colloid mill uses extremely high sheer to create oil droplets into a 5–10 micron drop range. The soap or surfactant in the emulsion acts to maintain the oil in the emulsified state by surrounding each droplet of oil with an electrically charged aqueous layer, causing the oil droplets to repel each other. This type of emulsion is referred to as an "oil-in-water" emulsion, since the oil exists in discrete droplets, and the water is the continuous phase. In preferred embodiment the components of the finished emulsion, tall oil pitch, fatty acids and emulsifying agents have a closed cup flash point exceeding 392° F. (200° C.).

Another formulation of the CCA can be obtained by the addition of a base to the fatty acid portion of the formulation. A suitable base is added to the liquid phase of the emulsion, which is composed of water and glycerides, or fatty acids. The base reacts with the fatty acids present in the glycerides to produce a soap by saponification that aids in the emulsion of the tall oil pitch. An example of such a reaction occurs when reacting a base with fatty acid glycerol ester, which forms soap, as shown in the following reaction:

$$(C_{17}H_{35}COO)_3C_3H_5+3NaOH \rightarrow C_3H_5(OH)_3+3C_{17}H_{35}COONa$$

Concentrations ranging from 0.05 to 0.1M NaOH to create the final emulsion have proven particularly successful for this technique. Experience has shown that not all pitches contain sufficient glyceride content to be emulsified by addition of water and a base. Adding a base to the water-glyceride mixture ensures the availability of free fatty acids for production of a soap-based emulsifier. Since a considerable portion of the fatty acid exists as free fatty acid, the following reaction also occurs with the free fatty acid:

$$C_{17}H_{35}COOH+NaOH \rightarrow C_{17}H_{35}COONa+H_2O$$

This also allows the use of multiple pitch feed stocks.

Both streams are subject to the shear of the emulsion mill and an emulsion is immediately formed. The emulsion can be stored at temperatures between 70° and 160° F. (21° C. and 71° C.) for time periods exceeding one month. When a base is added, the emulsification is accomplished by combining the glyceride-water-base mixture with pre-heated tall oil pitch at the high shear emulsion mill Creation of synfuel includes the recovery of coal fines as a first step or the creation of a finely ground coal stream. These coal fines can be screened, cleaned or dried. Various coal preparation plant techniques may be used to reduce ash and/or sulfur levels. The coal fines or grounds are mixed with the CCA of the invention and pressed into briquettes or some other saleable form, such as flakes, rods, spheres, squares and the like. Any of the saleable forms for the synfuel would be considered within the scope of this invention. This compaction further enhances the contact between the coal and the CCA. In this manner the customer receives a synfuel product that acts much like stoker coal.

Table 1 illustrates CCA performance data generated by CCA's formulated using the methods described in the present invention. CCA performance is measured by the ability of the CCA to produce chemical change. Chemical change is determined using Fourier Transform Infrared Spectroscopy (FTIR) technique.

In performing chemical change measurements FTIR spectra differences are determined between the synfuel and a simple physical mixture of the coal and CCA. For example, the synthetic fuel product consists of 99.3 wt % feedstock coal and 0.7 wt % CCA. A "simple physical mixture" spectrum would be the weighted average of the coal and the CCA spectra, or about 0.7% of the CCA spectra plus about 99.3% of the feed coal spectra. A measurable, significant difference between the weighted average spectrum and the synthetic fuel spectrum indicates that a chemical reaction occurred during the process and produced a significant chemical difference between the feedstock coal and the synthetic fuel product.

Three different commercially available fatty acid products were used in the evaluation that Table 1 is based upon. Sample number and components of the emulsion are presented. The table indicates that enhanced chemical change is achieved by addition of fatty acids to the emulsion matrix. The data indicates that on a wt/wt basis fatty acids impart more chemical change than tall oil pitch.

In all cases the emulsion formulations presented in Table 1 exhibited a water-like consistency at room temperature and achieved acceptable stability for synfuel applications.

TABLE 1

| Sample # | Water gr. | XD-70 gr. | SAL gr. | TOP gr. | AP 140 gr. | FFA gr. | % Chemical Change @ 0.75% application rate |
|---|---|---|---|---|---|---|---|
| 3 | 900 | 22 | | 450 | | | 18 |
| 7 | 900 | 22 | | 450 | | 44 | 23 |
| 8 | 900 | 22 | | 450 | 44 | | 28 |
| 10 | 900 | | 22 | 450 | | | 26 |

In Table 1, various available commercial compositions were used for the testing. The material used under the headings AP 140 and FFA are various compounds available from Cargill Industrial Oils and Lubricants, primarily comprising free fatty acids. AP 140 has the following general composition: 95.8% fatty acids, 0.8% diglycerides, 0.4% triglycerides, and 3% misc. unknown. FFA typically has the following composition 95.8% fatty acids, 3.1% diglycerides, and 1.1% triglycerides. TOP is tall oil pitch. Indulin® XD-70 and Indulin® SAL are both tradenames for emulsifiers that are produced by Westvaco Corporation. Indulin® XD-70 is a non-ionic surfactant that is composed of nonylphenol polyethylene glycol ether. Indulin® SAL is a lignate based anionic emulsifier.

Table 2 presents results of tests on synfuel prepared in accordance with the current invention. The feedstock coal was a typical West Virginia bituminous blend. The CLC 1 chemical change agent used tall oil pitch as the solid phase of the emulsion without the addition of further fatty acids. CLC-1 contained 55% solids.

The CLC 2 chemical change agent was a tall oil pitch based emulsion with added fatty acid material used in the solid phase of the CCA. This emulsion contained 30% tall oil pitch and about 2% fatty acid.

Table 2 indicates that the addition of fatty acid containing material increases the chemical change ability of the emulsion.

TABLE 2

| Sample Date | Site | Chemical Change Agent | % Dosage Chemical Change Agent | % Chemical change | % Chemical Change/# solid phase in emulsion |
|---|---|---|---|---|---|
| Apr. 5, 2001 | Line C | CLC 1 | .8 | 27 | 3.1 |
| Apr. 5, 2001 | Line C | CLC 2 | .4 | 17 | 5.3 |
| Apr. 5, 2001 | Line C | CLC 2 | .6 | 23 | 4.8 |
| Apr. 5, 2001 | Line C | CLC 2 | .8 | 27 | 4.2 |
| Apr. 5, 2001 | Line C | CLC 2 | 1 | 30 | 3.8 |

Further tests have demonstrated the propensity of fatty acids to enhance the amount of chemical change for synfuels. Table 3 shows the results of these tests. Four emulsion formulations were tested at an application rate of 0.75, with the exception of sample 18*a* being tested at an application rate of 0.25. The data in Table 3 indicates that fatty acids alone contribute to chemical change. In particular, samples 18 and 18*a* both have considerable chemical change, without adding any tall oil pitch. Since the pH is in the range that could have microbial growth within the fatty acid emulsion, anti-microbial additives can be added to reduce this problem.

Tall oil pitch is used in the CCA emulsion since fatty acids do not have a readily available source and are expensive. Tall oil alone would be sufficient to create a CCA, but has some less desirable effects when compared with the other CCA's described in this invention. In order to achieve the desired pH range for the CCA emulsion described in this invention, caustic needs to be added to raise the pH of the tall oil pitch emulsion. Tall oil alone also places limitations on the selection of surfactant (i.e. cationic surfactant). Additionally, other chemicals react with tall oil pitch, which makes a less effective product.

TABLE 3

| Sample | Water, grams | SAL, grams | TOP, grams | AP 140, grams | pH, initial | Application Rate | % chemical change |
|---|---|---|---|---|---|---|---|
| 11 | 900 | 22 | 495 | | 7.2 | .75 | 25 |
| 14 | 900 | 22 | 450 | 44 | 7.0 | .75 | 27 |
| 18 | 700 | 15 | | 300 | 6.0 | .75 | 36 |
| 18a | 700 | 15 | | 300 | 6.0 | .25 | 22 |

The surfactant useful in this invention includes virtually all classifications of cationic, anionic and non-ionic materials with the emphasis being on cost effectiveness.

One important characteristic of the highly desirable surfactant is that it allows the emulsion to break shortly after mixing with the coal. The surfactant maintains the glycerides in a uniform emulsion so that it is evenly distributed as it is mixed with the coal. However, to achieve chemical change, the glycerides must contact the coal surface. This involves the rupturing of the aqueous sphere that surrounds each emulsion droplet. The mixture of the coal and emulsion hardens as the emulsion breaks and the water evaporates. This allows for a rapid set and minimizes gumming and sticking. In the current invention, no additional heat to the mixture is required to perform this function.

Many surfactants are available to perform the noted function, if sufficient soap cannot be produced from the saponification of free fatty acids in the glyceride stream. The goal with the soap is to have the cheapest source available. For example, the waste product from a corn or other grain fermentation process is a slurry that is rich in glycols. Such a waste product can be converted into a suitable anionic surfactant through reaction with caustic.

Similarly, lignin and other paper pulping derivatives from the pulping mill can be treated with caustic to effect a saponification reaction and produce an anionic surfactant. Crude tall oil (CTO) is a preferred base for the soap. Sodium lignum sulfonate is also a desirable base for the soap.

Anionic soaps are a preferred surfactant due to an additional benefit received. Emulsions made with anionic soaps have oil droplets with a negative charge. Coal, due to the inorganic sulfur content, tends to be somewhat acidic, i.e. positively charged. The electrostatic attraction between the positively charged coal and the negatively charged emulsion oil droplets enhances coal-CCA contacting.

Amphoteric soaps, such as ethylene-oxide based soap, nonionic soaps and cationic soaps also work, but without this electrostatic attraction.

In this invention, the temperature at which the synfuel will spontaneously combust is similar to that of the parent coal such that the synfuel can be stored, handled, and processed in the same way as the parent coal. The CCA has a flash point of 392° F. (200° C.), as opposed to the lower flash points seen in some current CCA's. The higher flash point reduces the risk of fire. The stickiness of previous products is also avoided.

The advantages obtained with the CCA of the invention include decreased CCA viscosity at ambient temperatures, more uniform spreading of the CCA across the surface of the coal particles, and more efficient CCA utilization. Furthermore the CCA will produce a greater degree of significant chemical change as defined in Section 29 of the IRS tax code than do CCA's currently produced for the same dosage.

The present invention has many advantages over CCA's created from tall oil pitches of the prior art. One such advantage is that fatty acid materials are compatible with the tall oil pitch emulsion. Another advantage is that the desired amount of chemical change can be achieved by controlling the amount of fatty acid material incorporated into the emulsion. Fatty acid emulsions using only fatty acids in the solid phase have been found to be good chemical change agents. Also, advantageous is the fact that formulations presented in this invention can be stored at temperatures from 70° F. to 160° F. (21° C. to 71° C.). One further advantage is that microbiological growth is minimized due to the strict pH control in the basic range for the formulation containing tall oil pitch, as previously discussed.

From the foregoing it will be seen that this invention is one well adapted to attain all of the ends and objects hereinabove set forth, together with other advantages which are obvious and which are inherent to the method and product.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying specification is to be interpreted as illustrative and not in a limiting sense.

For example, one can add additional components such as antifungal or antimicrobial additives, surface tension modifiers or the like and still gain the benefits of the invention However, this invention is sufficient to achieve the creation of synfuel with only the addition to coal of the chemical change agent that contains only tall oil pitch, glycerides and surfactant with sufficient water to create the emulsion. Additionally, the addition of a chemical change agent that contains only water, glycerides, and surfactants to coal is another sufficient method of creating a synfuel.

What is claimed is:

1. A chemical change agent for preparing a synthetic fuel comprising:

water;

glycerides;

a surfuctant; and a tall oil pitch.

2. The chemical change agent for preparing a synthetic fuel of claim 1 wherein the glycerides have a carbon number of sixteen to eighteen.

3. The chemical change agent for preparing a synthetic fuel of claim 1 wherein the glycerides are vegetable oil.

4. The chemical change agent for preparing a synthetic fuel of claim 1 wherein the glycerides are selected from the group consisting of soybean oil, palm oil, corn oil, and cotton seed oil.

5. The chemical change agent for preparing a synthetic fuel of claim 1 wherein the pH is maintained between about 7.0 and 11.0.

6. The chemical change agent for preparing a synthetic fuel of claim 1 wherein a portion of the surfactant is created through the addition of a base to the glycerides.

7. The chemical change agent for preparing a synthetic fuel of claim 1 wherein the water is from up to 70 wt. % of the chemical change agent;

the tall oil pitch is from up to 60 wt. % of the chemical change agent;

the glycerides are from 0.25 wt. % to 44 wt. % of the chemical change agent; and the surfactant is from 0.25 wt. % to 4 wt. % of the chemical change agent.

8. The chemical change agent for synthetic fuel of claim 1 wherein the chemical change agent is characterized as having a viscosity between around 50 centipoise to about 200 centipoise.

9. The chemical change agent fur synthetic fuel of claim 1 wherein the chemical change agent is characterized as having a sulfur content of less than 0.2% by weight.

10. The chemical change agent for preparing a synthetic fuel for synthetic fuel of claim 1 wherein the chemical change agent is characterized as having a closed cup flash point of at least about 392° F. (200° C.).

11. The chemical change agent for preparing a synthetic fuel of claim 1 wherein the chemical change agent creates a stable emulsion at storage temperatures between about 70° F. and 160° F. (21° C. and 71° C.).

12. The chemical change agent for preparing a synthetic fuel of claim 1, wherein the surfactant is an anionic soap.

13. The chemical change agent for preparing a synthetic fuel of claim 1, wherein the surfactant is derived from tall oil.

14. A method of producing a chemical change agent comprising the steps of:

combining water, glyceride, and a surfactant;

heating a tall oil pitch to at lout about 200° F. (93° C.); and adding tall oil pitch and the water, glycerides, and the surfactant to form an emulsion.

15. The method of producing a chemical change agent of claim 14, further including the step of subjecting the emulsion to shear in a mixer.

16. The method of producing a chemical change agent of claim 14, wherein the emulsion is in droplets between 5 microns 10 microns.

17. The method of producing a chemical change agent of claim 14, wherein the step of adding tall oil pitch and the water, glycerides, and surfactant is performed using a mixer, wherein the mixer is a colloid mill or a turbine type rotor-stator device.

18. The method of producing a chemical change agent of claim 14, further including the following stop of adding a base to the water, glycerides, and surfactant before adding the pitch oil and forming the emulsion until the chemical change agent has a concentration of about 0.05 mol % to about 0.1 mol % base.

19. A solid synthetic fuel comprising:

solid coal treated with a chemical change agent, the chemical change agent including water in a continuous phase; glycerides in a discrete phase; and a surfactant.

20. A synthetic fuel comprising:

coal;

water;

glycerides;

a surfactant; and tall oil.

21. The synthetic fuel of claim 20 wherein the coal is in a range of about 98.8 weight percent to about 99.5 weight percent of the Synthetic fuel mid wherein the water, glycerides, the surfactant, and the tall oil form a chemical change agent that is in a range of about 0.5 weight percent to about 1.2 weight percent of the synthetic fuel.

22. A method of producing synthetic fuel comprising the steps of:

mixing fine carbonaceous material with a chemical change agent comprising an emulsion of water, tall oil, glycerides, and surfactant; and pressing the carbonaceous material with chemical change agent into a briquette.

23. A method of producing synthetic fuel comprising the steps of:

mixing fine carbonaceous material with a chemical change agent comprising an emulsion of water, glycerides, and surfactant; and pressing the carbonaceous material with chemical change agent into a briquette.

* * * * *

UNITED STATES PATENT AND TRADEMARK OFFICE

CERTIFICATE OF CORRECTION

PATENT NO. : 6,887,282 B2 
DATED : May 3, 2005
INVENTOR(S) : Vince M. Giampa, John T. Dubiel and Orville Lyons It is certified that error appears in the above-identified patent and that said Letters Patent is hereby corrected as shown below:

Column 8,
Line 3, change “44” to -- 40 --.
Line 29, change “glyceride” to -- glycerides --.
Line 30, change “lout” to -- least --.
Line 38, after “microns” (first occurrence) insert -- to --.
Line 66, change “mid” to -- and --.

Signed and Sealed this

Third Day of January, 2006

JON W. DUDAS
*Director of the United States Patent and Trademark Office*